US006012948A

United States Patent [19]

Wu

[11] Patent Number: 6,012,948

[45] Date of Patent: Jan. 11, 2000

[54] BOARDLOCK FOR AN ELECTRICAL CONNECTOR

[75] Inventor: Kun-Tsan Wu, Tu-Dhen, Taiwan

[73] Assignee: Hon Hai Precision Ind. Co., Ltd., Taipei Hsien, Taiwan

[21] Appl. No.: 08/892,916

[22] Filed: Jul. 15, 1997

[30] Foreign Application Priority Data

Jul. 18, 1996 [TW] Taiwan ..... 85210941

[51] Int. Cl.[7] ..... H01R 13/60

[52] U.S. Cl. ..... 439/567; 439/607

[58] Field of Search ..... 439/79, 567, 607, 439/609, 901, 904

[56] References Cited

U.S. PATENT DOCUMENTS 5,145,407 9/1992 Obata et al. ..... 439/567

5,273,460 12/1993 Arai ..... 439/609

5,599,207 2/1997 Lai ..... 439/567

*Primary Examiner*—Khiem Nguyen

[57] ABSTRACT

A boardlock for an electrical connector is disclosed. The boardlock comprises an attachment section for attaching to an electrical connector and an insertion section for inserting into a hole of a circuit board. The insertion section includes a leg plate and a spring piece laterally bulging from a lateral portion of the leg plate. The spring piece is a strip bending out of the leg plate in V shape from its middle portion with both ends of the spring piece connected to the leg plate. Also, a shielding device for an electrical connector comprising a pair of above-mentioned boardlocks integrally formed on it is disclosed.

1 Claim, 6 Drawing Sheets

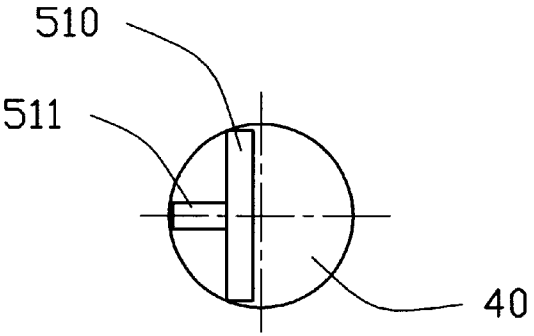
FIG.5(A)
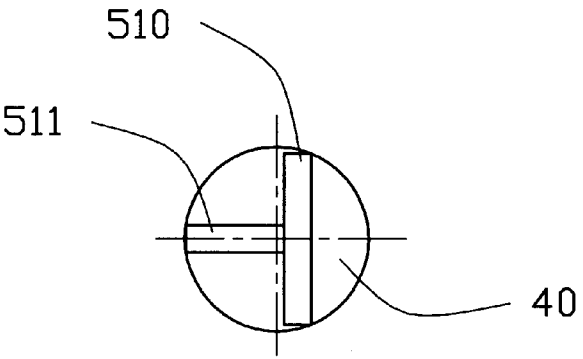
FIG.5(B)
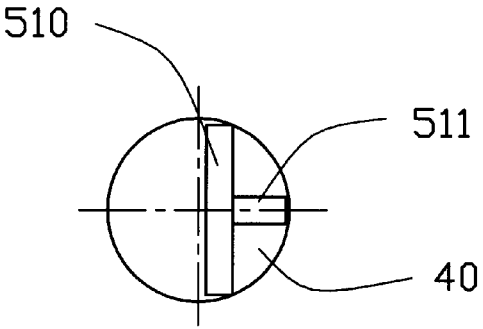
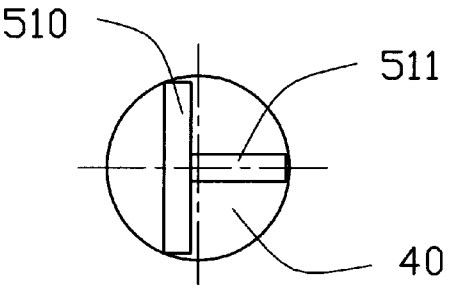

BOARDLOCK FOR AN ELECTRICAL CONNECTOR

BACKGROUND OF THE INVENTION

1. Field of the Invention

The invention relates to a boardlock for an electrical connector.

2. The Prior Art

Boardlocks are used frequently in electrical connectors for facilitating fastening connectors to a circuit board.

Attaching of a conventional boardlock to a housing for a connector substantially fall into three approaches, as shown in FIGS. 1A, 1B and 1C. In FIG. 1A, riveting is used; in FIG. 1B, a boardlock is bolted onto the housing; while in FIG. 1C, snapping means is used. In all of these three kinds of boardlocks, though the approaches to attaching to a housing are different, the means for attaching to a circuit board are the same. Please refer to FIG. 2, a pair of legs including a pair of outward protrusions are provided on a lower portion of each of the boardlocks shown in FIGS. 1A–1C for fixing into a hole of a circuit board. AS can be seen in FIG. 2, in a conventional boardlock, the narrowest outer width of the pair of legs should be smaller than the diameter of the hole while the widest outer width thereof should be larger than the diameter of the hole to facilitate the insertion of legs into the hole. Since various kinds of circuit boards from different vendors may have different tolerance in relative position between holes and in diameter of holes, such a boardlock design will encounter the problem that there may be a relatively large clearance "t" exists between the outer faces of the legs and the diameter of the hole. This results in escape of the boardlock form the hole of the circuit board in transportation or while vibration occurs before wave-soldering procedure. In addition, the boardlock may escape out of the hole due to the buoyancy of the molten solders during wave-soldering procedure.

Hence, there is a need for a boardlock for an electrical connector that can overcome the above-mentioned problems and shortcomings.

SUMMARY OF THE INVENTION

Accordingly, one object of the present invention is to provide a boardlock for an electrical connector which firmly latches in a hole of a circuit board before wave-soldering procedure.

Another object of the present invention is to provide a boardlock for an electrical connector which is formed as an integral portion of a shielding device for an electrical connector.

To fulfill the above-mentioned objects, according to one embodiment of the present invention, a boardlock for an electrical connector comprises an attachment section for attaching to an electrical connector and an insertion section for inserting into a hole of a circuit board, wherein the insertion section includes a leg plate and a spring piece laterally bulging from a lateral portion of the leg plate. In one preferred embodiment, the spring piece is a strip bending out of the leg plate in V shape from its middle portion with both ends of the spring piece connected to the leg plate.

In another embodiment, a shielding device for an electrical connector according to the present invention comprises at least one boardlock stamping integrally therefrom for fixing onto a circuit board. The boardlock includes a leg plate extending from the shielding device and a spring piece laterally bulging from a lateral portion of the leg plate.

These and additional objects, features, and advantages of the present invention will be apparent from a reading of the following detailed description of the embodiments of the invention taken in conjunction with the appended drawing figures, which are described briefly immediately below.

BRIEF DESCRIPTION OF THE DRAWINGS

FIGS. 5A and 5B illustrate the functioning of the present boardlocks.

DETAILED DESCRIPTION OF THE PREFERRED EMBODIMENTS

Figure 1B:
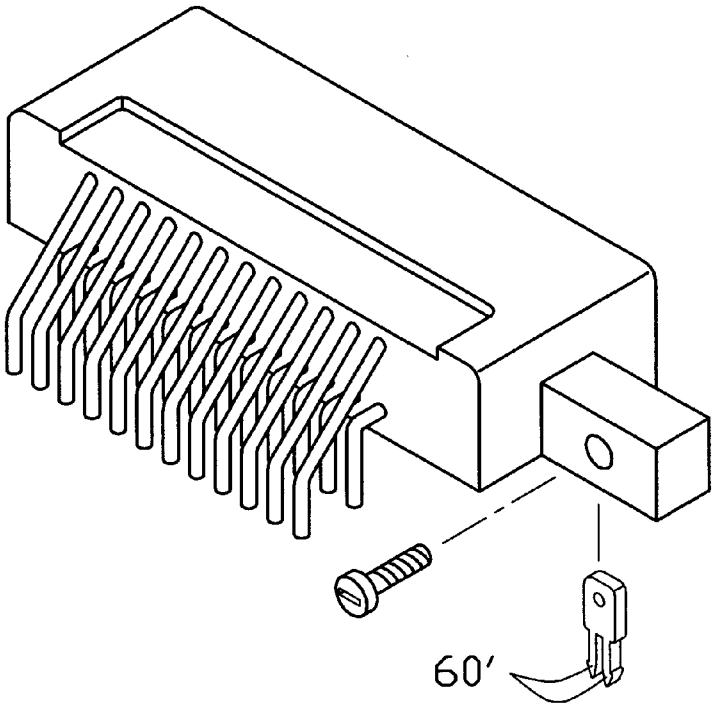
FIG.1(B) (PRIOR ART)
FIG. 1B shows another conventional approach to attach a boardlock to a housing for an electrical connector.
Figure 1A:
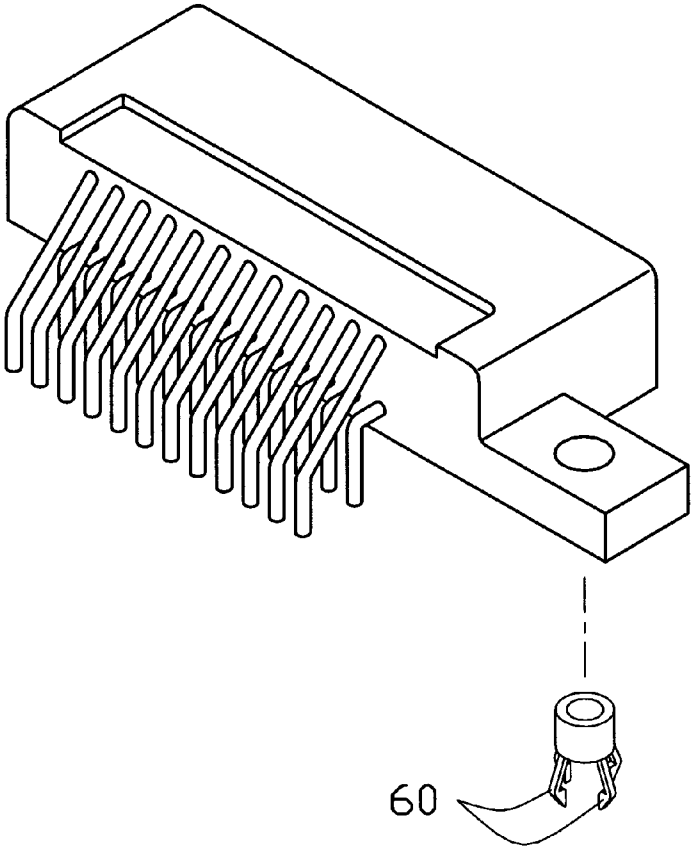
FIG.1(A) (PRIOR ART)
FIG. 1A shows one conventional approach to attach a boardlock to a housing for an electrical connector.
Figure 2:
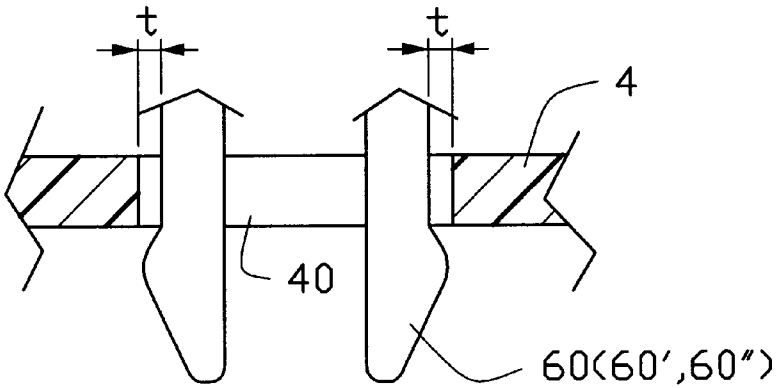
FIG.2 (PRIOR ART)
FIG. 2 shows a conventional means for fixing a boardlock into a hole of a circuit board.
Figure 1C:
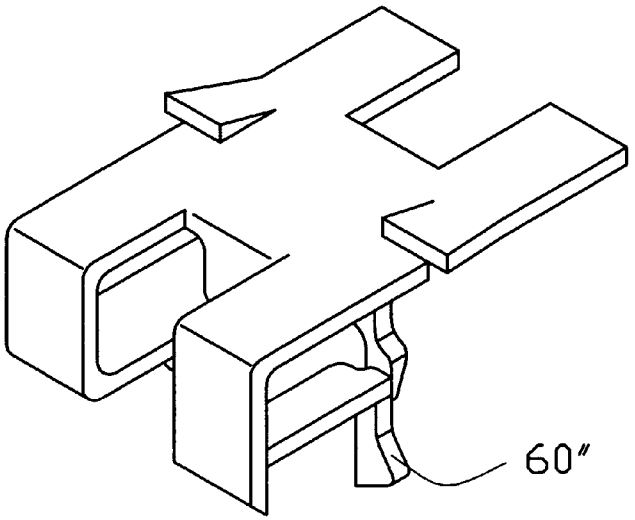
FIG.1(C) (PRIOR ART)
FIG. 1C shows still another conventional approach to attach a boardlock to a housing for an electrical connector.

Reference will now be made in detail to the preferred embodiments of the present invention. It will be noted here that for a better understanding, most of like components are designated by like reference numerals throughout the various figures in the embodiments.

Figure 3:
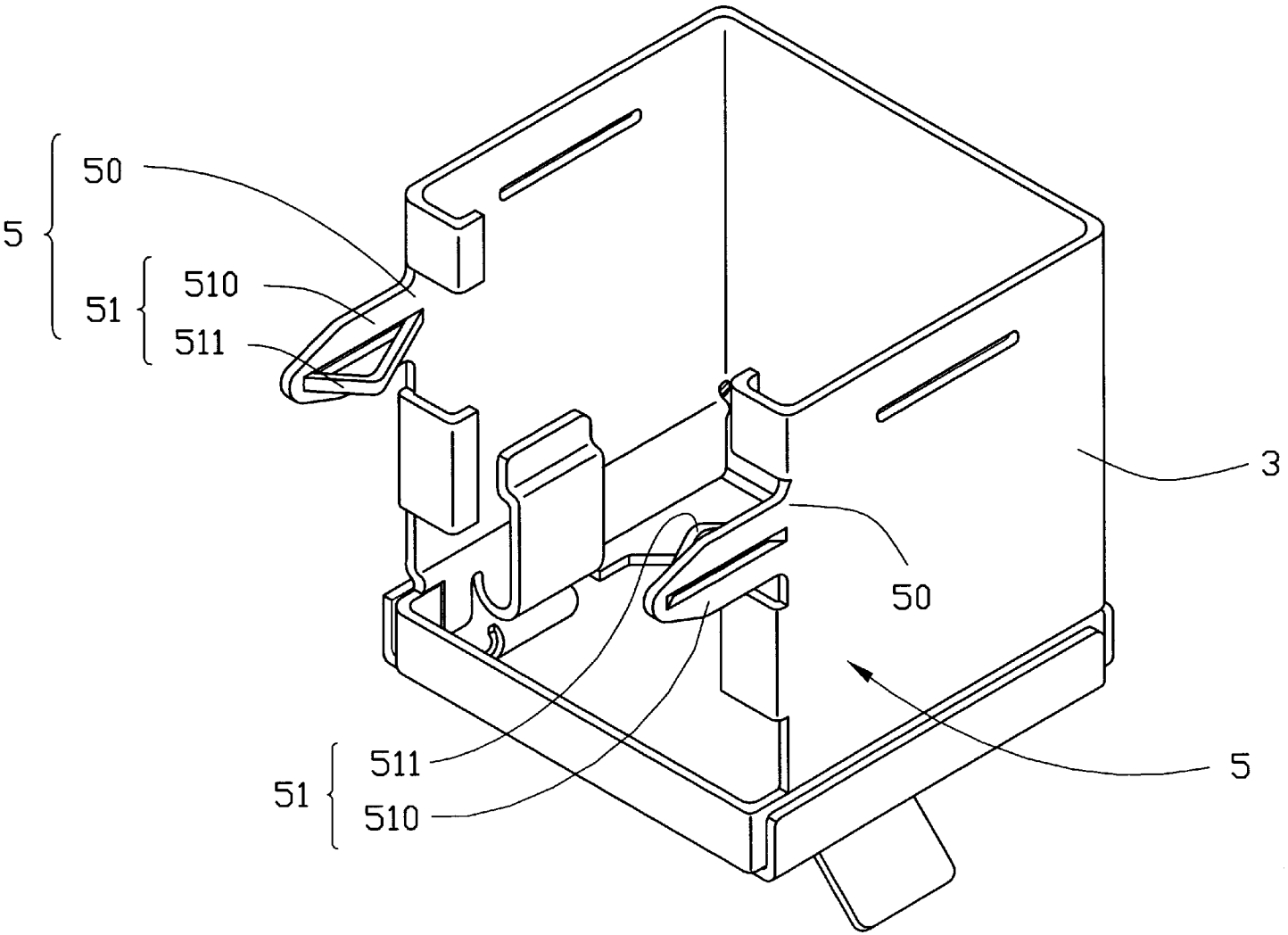
FIG. 3 shows a boardlock used in a USB connector according to one embodiment of the present invention.

Referring now to FIG. 3, a boardlock integrally formed on a shielding device for an electrical connector according to the present invention is generally designated at 5. The boardlock 5 is generally made of a plate, comprising an attachment section 50 and an insertion section 51. In the present preferred embodiment, the attachment section 50 is integrally formed on the shielding device 3 by stamping. In other words, a pair of boardlocks 5 are integrally formed with the shielding device 3 by stamping.

The insertion section 51 extends from a lower portion of the attachment section 50 and comprises a straight leg plate 510 and a spring piece 511 laterally stamped inward from the leg plate 510. The spring piece 511 is a strip bending out of the leg plate 510 in V shape at its middle portion with both ends connected to the leg plate 510 for providing spring force against an inner wall of a hole on a circuit board.

A distance between a pair of leg plates 510 (referred to "plate distance" hereinafter) may be different from a distance between the centers of a pair of holes (referred to "center distance" hereinafter) on the circuit board so as to enhance the latching effect of the boardlocks 5. FIGS. 5A and 5B show latching effect of the present boardlocks, in which the plate distance is shorter than the center distance. At the first stage of inserting a pair of leg plates 510 into a pair of holes on a circuit board, as shown in FIG. 5A, the lower portion of the spring pieces 511 just touch the inner walls of the holes and the plate distance is smaller than the center distance, with little forces exerting on the walls by the spring pieces 511 and thus little forces on the insertion sections 51 due to reaction forces by the walls.

Then, when the insertion sections 51 advance so that the inner most point of the spring pieces 511 (the tip of the "V") reaches the wall, the spring pieces 511 are pushed outward by the fixed inner walls of the holes, and in turn, the leg plates 510 are pushed outward by the spring pieces 510 so that the plate distance is large than the center distance, with relatively large forces acting between the boardlocks and the holes. The boardlocks are thus firmly latchably fixing onto the circuit board.

Figure 4A:
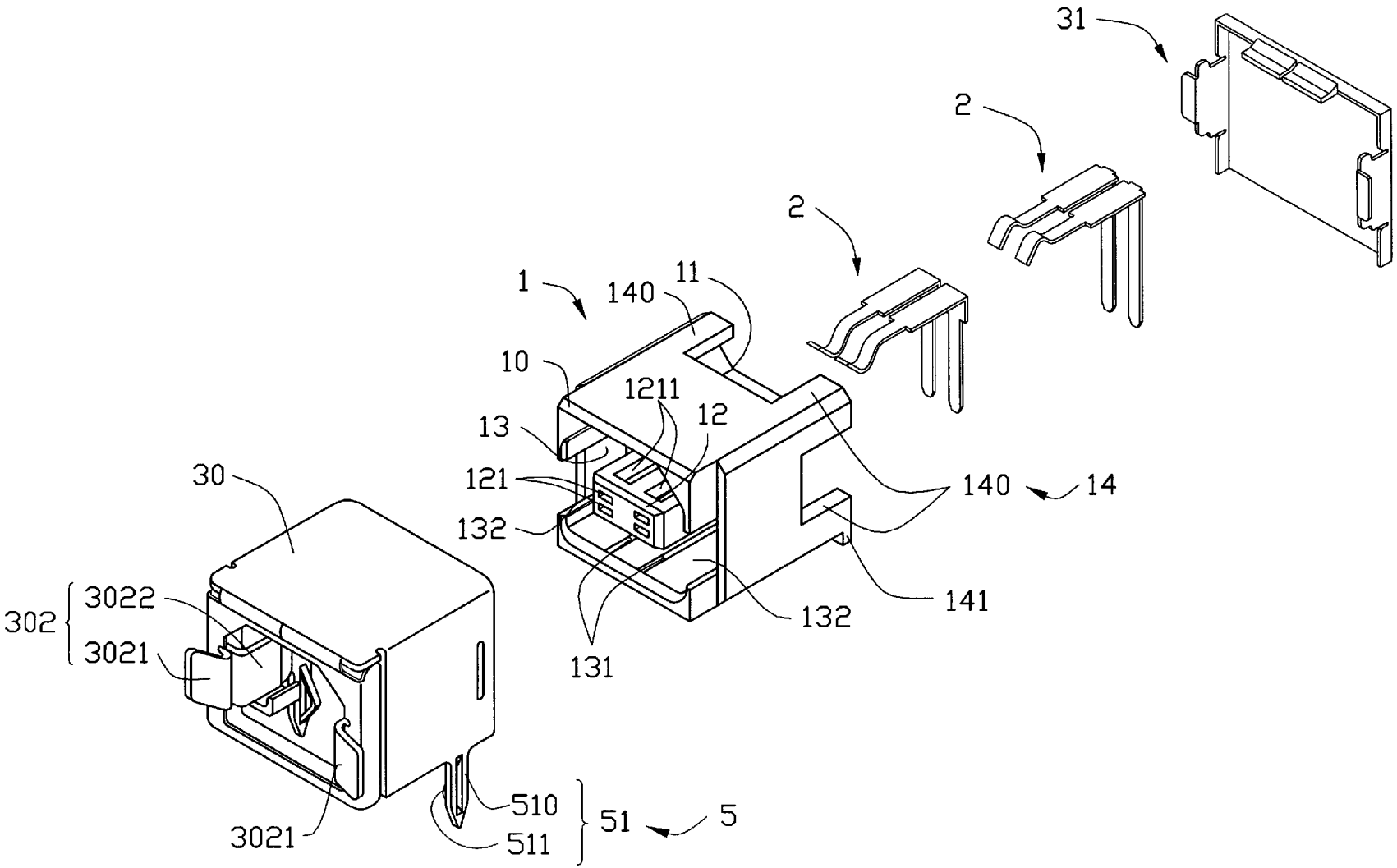
FIGS. 4A and 4B show an exploded perspective view and an assembled perspective view of an electrical connector including a boardlock according to one embodiment of the present invention.
Figure 4B:
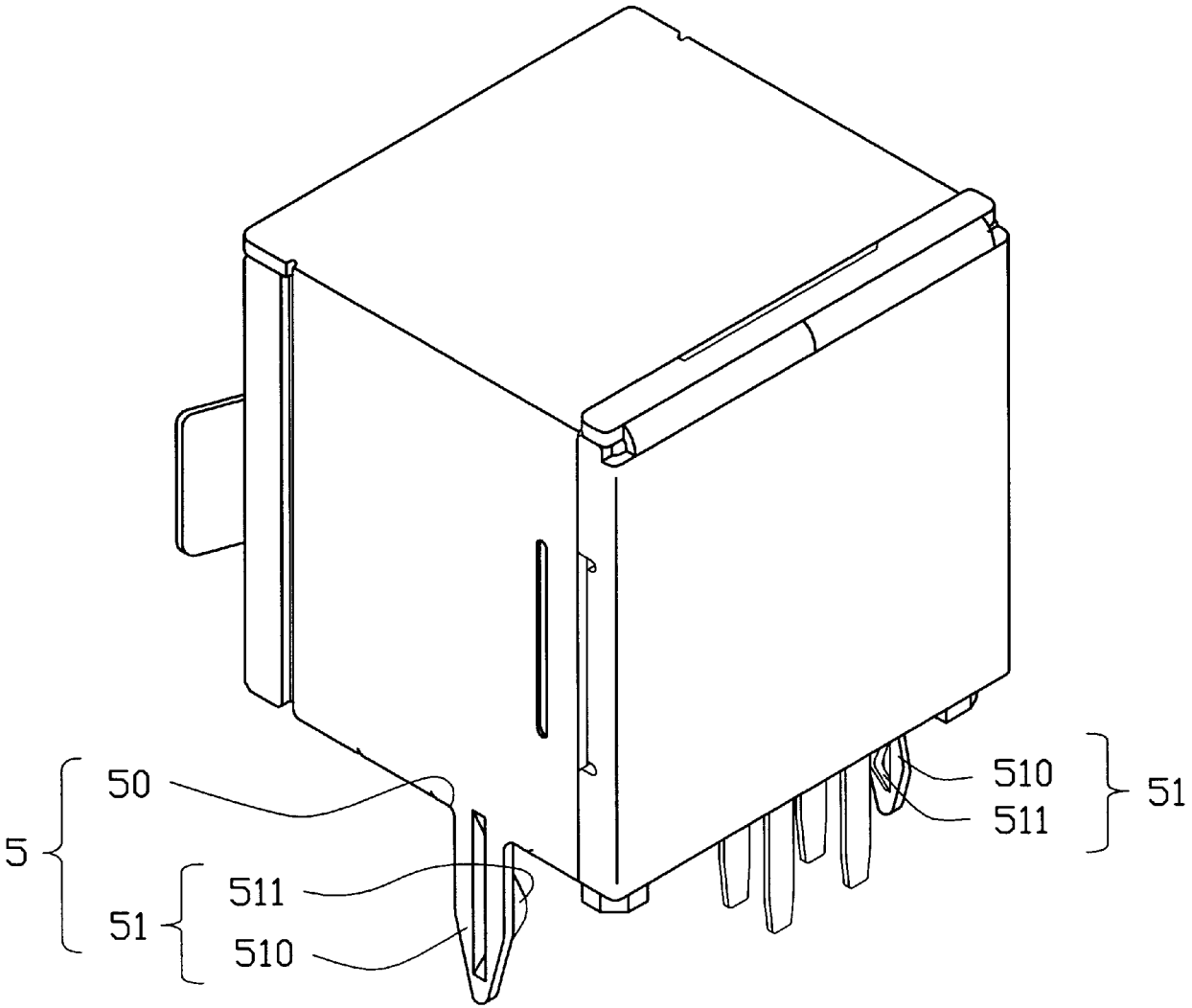

Referring now to FIGS. 4A and 4B, an exploded perspective view and an assembled perspective view of an electrical connector including a boardlock according to one embodiment of the present invention are shown. The electrical connector comprises an insulating housing 1, a plurality of conductive contacts 2 and a shielding device 3.

The housing 1 comprises a front face 10, a rear face 11, an annular recess 13 defined on the front face 10 and a central portion 12 surrounds by the annular recess 13. A plurality of passageways 121 are provided on the housing 1 communicating between the front face 10 and the rear face 11 for receiving the plurality of contacts 2. A plurality of apertures 1211 are provided on the central portion 12 communicating between the passageways 121 and the annular recess 13. A contacting portion of the contacts 2 received in the passageways 121 bulges through the aperture 1211 into the recess 13 for mating a contact of a mating connector.

A plurality of ribs 131 are provided on an inner periphery of the recess 13 for firmly receiving a mating connector. A pair of cutouts 132 are provided on both sides of the recess 13 for receiving grounding means 302 on the shielding device 3, which will explain more clearly later.

Standoff means 14 is provided on the housing 1 for standing off on a circuit board in either horizontal position or in vertical position. Four standing posts 140 extend reward from four corners of the housing 1 for standing off vertically. Two standoffs 141 are provided on distal ends of a lower pair of the standing posts 140 and at least one standoff (not shown) is provided on a bottom of the housing 1 for standing off horizontally.

The shielding device 3 is designed as a two-piece device, including a front shell 30 and a rear shell 31 latchably engaging the front shell 30. A pair of boardlocks 5 are integrally formed on a pair of bottom edges of the front shell 3, and the detail and functioning thereof are described previously. The shielding device further comprises grounding means 302. The grounding means 302 comprises a pair of grounding tangs 3021 extending forward for engaging a panel of a computer shell and a pair of grounding clips 3022 extending rearward for engaging a mating connector. The grounding clips 3022 may freely, laterally move in the cutouts 132 of the housing 1 to facilitate engagement with a mating connector.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

It is claimed that:

1. A method for mounting at least one boardlock to a corresponding hole in a PC board, said boarlock including a leg plate with spring means perpendicular to said leg plate, the steps including:

initially inserting the boardlock into the corresponding hole wherein the spring means exerts little force against a wall of the hole so as to have the leg plate share a same semi-circle cross-section with the spring means; and successively inserting the boardlock into the corresponding hole wherein the spring means exerts much force against the wall of the hole so as to have the leg plate move away from said semi-circle cross-section to another complementary semi-circle cross-section.

* * * * *